US005239150A

United States Patent [19]

Bolongeat-Mobleu et al.

[11] Patent Number: 5,239,150

[45] Date of Patent: Aug. 24, 1993

[54] MEDIUM VOLTAGE CIRCUIT BREAKER WITH OPERATING MECHANISM PROVIDING REDUCED OPERATING ENERGY

[75] Inventors: Roger Bolongeat-Mobleu, Echirolles; Olivier Cardoletti, Grenoble; Peter Malkin, St. Ismier, all of France

[73] Assignee: Merlin Gerin, France

[21] Appl. No.: 889,408

[22] Filed: May 28, 1992

[30] Foreign Application Priority Data

Jun. 3, 1991 [FR] France ..... 9106981

[51] Int. Cl.[5] ..... H01H 33/04; H01H 9/30; H01H 33/42; H01H 33/915

[52] U.S. Cl. ..... 200/148 R; 200/144 B; 200/147 R; 200/148 B; 200/148 F

[58] Field of Search ..... 200/144 B, 145, 147 R, 200/148 R, 148 A, 148 B, 148 F

[56] References Cited

U.S. PATENT DOCUMENTS

| | | | |
|---|---|---|---|
| 3,671,696 | 6/1972 | Brunner | 200/144 B |
| 4,309,581 | 1/1982 | Macaire et al. | 200/148 R |
| 4,458,119 | 7/1984 | Hashimoto et al. | 200/145 |
| 4,737,607 | 4/1988 | Bernard et al. | 200/147 R |
| 5,003,138 | 3/1991 | Bolongeat-Mobleu et al. | 200/147 R |
| 5,155,315 | 10/1992 | Malkin et al. | 200/148 R |

FOREIGN PATENT DOCUMENTS

| | | |
|---|---|---|
| 0011542 | 5/1980 | European Pat. Off. . |
| 0092205 | 10/1983 | European Pat. Off. . |
| 841472 | 7/1960 | United Kingdom . |
| 2103018 | 2/1983 | United Kingdom . |

*Primary Examiner*—J. R. Scott

*Attorney, Agent, or Firm*—Parkhurst, Wendel & Rossi

[57] ABSTRACT

A medium voltage circuit breaker, including first and second arcing contacts, the first arcing contact being longitudinally slidable with respect to the second arcing contact between open and closed positions, first and second main contact, the first main contact being movable with respect to the second main contact between open and closed positions, a sealed enclosure filled with a high dielectric strength gas and housing the first and second arcing and main contacts, and operating mechanism for closing the first and second arcing contacts before the first and second main contacts close and for opening the first and second arcing contacts after the first and second main contacts open. The operating mechanism is mechanically coupled to the first arcing and the first main contacts and comprises a compressible linkage coupled to the first arcing contact. The compressible linkage is compressible a predetermined distance against an urging force provided by a spring as the first and second arcing contacts close, thereby compressing the spring. The operating mechanism is adapted to reduce compression of the spring and reduce a contact force between the first and second arcing contacts after the main contacts have closed.

9 Claims, 4 Drawing Sheets

MEDIUM VOLTAGE CIRCUIT BREAKER WITH OPERATING MECHANISM PROVIDING REDUCED OPERATING ENERGY

BACKGROUND OF THE INVENTION

The invention relates to a medium voltage circuit breaker with reduced operating energy having an elongated sealed enclosure filled with high dielectric strength gas, a pair of arcing contacts, one arcing contact being longitudinally slidable and adapted to occupy an open position in which the arcing contacts are separated and a closed position in which the arcing contacts are in abutment. The circuit breaker also includes a pair of main contacts, one main contract being movable, an operating mechanism requiring an operating energy substantially corresponding to that required to move the movable main contact and the movable arcing contact which are coupled to the mechanism. The mechanism is arranged to close the arcing contacts before the main contacts and to open the main contacts before the arcing contacts, and includes an arcing contact pressure spring, whose force corresponds to the electrodynamic repulsion forces of the arcing contacts generated by the current flow.

A circuit breaker of the kind referred to above enables the main contacts to be open and closed without an arc, the current being shunted by the arcing contacts. Shunting of the current by the arcing contacts can be performed only if the latter are correctly closed, and it is therefore indispensable to prevent opening due to the effect of the electrodynamic repulsion forces. The force of the arcing contact pressure spring must be able to overcome these repulsion forces, and it is dimensioned accordingly. This spring is compressed at each operation by the operation mechanism which supplies it with a corresponding energy.

In a state-of-the-art circuit breaker (U.S. Pat. No. 4,309,581) with gas self-blast, this energy is recovered when the circuit breaker opens and is used to move the arc blowout gas compression piston.

The development of new breaking techniques, i.e. breaking by auto-expansion and/or rotating arc and vacuum breaking noting (U.S. Pat. Nos. 4,737,607 and 5,155,315) has enabled the gas-blast pistons to be suppressed, and the energy stored in the contact pressure spring is recovered by the mechanism, equipped with damper or energy dissipating systems.

The present invention is based on the observation that the contact pressure at the level of the arcing contacts is only useful during a short period when the current is branched off through the arcing contacts. So long as or as soon as the main contacts are closed, the current flows through these main contacts and the arcing contacts are not subjected to any repulsion effect. The arm of the present invention is to reduce as far as possible the energy required for operation of the circuit breaker and notably the energy for compression of the arcing contact compression spring. It also aims to reduce the contact pressure when the circuit breaker is closed, thus reducing the stresses exerted on the enclosure, generally made of resin, and the risks of creep.

SUMMARY OF THE INVENTION

The circuit breaker according to the invention is characterized in that the movable arcing contact operating mechanism comprises a telescopic link having a limited travel corresponding to the overtravel imposed by the arcing contacts closing prior to and opening subsequent to the main contacts, that the spring is inserted in the telescopic link in a precompressed state, and that the mechanism is arranged to successively impose in the course of a circuit breaker closing order an increased compression of said spring, followed by a reduction of this compression at the end of the closing movement inversely, in the course of a circuit breaker opening order, an increased compression of the spring is provided, followed by a reduction of this compression and separation of the arcing contacts.

The spring is precompressed at the force necessary to withstand the electrodynamic repulsion forces, and this force is present as soon as the arcing contacts come into abutment. The additional compression travel of the spring can be small and is determined by the mechanism which brings about closing or opening of the main contacts during this additional travel. The potential energy stored in the spring and thereby the energy supplied by the mechanism are thus notably reduced and the mechanism can be designed to simply move the movable contacts. The whole operation is thus simplified. The contact pressure is exerted only during the short period during which the current is shunted through the arcing contacts.

According to a development of the invention, the movable arcing contact is operated by a telescoping moving link appreciably to the dead point position when closing of the arcing contacts occurs. The additional compressing of the spring thus takes place in the neighborhood of the dead point and the torque necessary for this additional compression is relatively low. This arrangement also allows limited travel of the arcing contact in the closed position, whereas the main contact, operated by another crank, continues its movement. In the closed position of the circuit breaker, the arcing contacts can be closed, the telescoping link being slightly beyond the dead point to reduce the contact pressure, but it is also possible to reopen the arcing contacts slightly by over-shooting the dead point of the toggle. This overshoot must naturally be small enough to ensure closing of the arcing contacts, when an opening operation takes place, before separation of the main contacts.

The invention is applicable to all breaking devices requiring a small operating energy, (e.g.) gas self-blast devices by auto-expansion and/or arc rotation and to vacuum breaking devices. As described in U.S. Pat. No. 5,155,315, the vacuum or auto-expansion cartridge is housed in a sealed enclosure filled with high dielectric strength gas, notably sulphur hexafluoride, and in this enclosure there are housed, adjacent to the cartridge, the main circuit containing the main contacts is advantageously arranged parallel and next to the shunt circuit containing the arcing contacts, and the movable main contact is a pivoting contact connected to a crank fixedly secured to the arcing contact operating handle.

It is clear that the invention is applicable to other breaking devices requiring low operating energies.

BRIEF DESCRIPTION OF THE DRAWINGS

Other advantages and features will become more clearly apparent from the following description of an illustrative embodiment of the invention, given as a non-restrictive example only and represented in the accompanying drawings, in which.

DESCRIPTION OF THE PREFERRED EMBODIMENT

Figure 1:
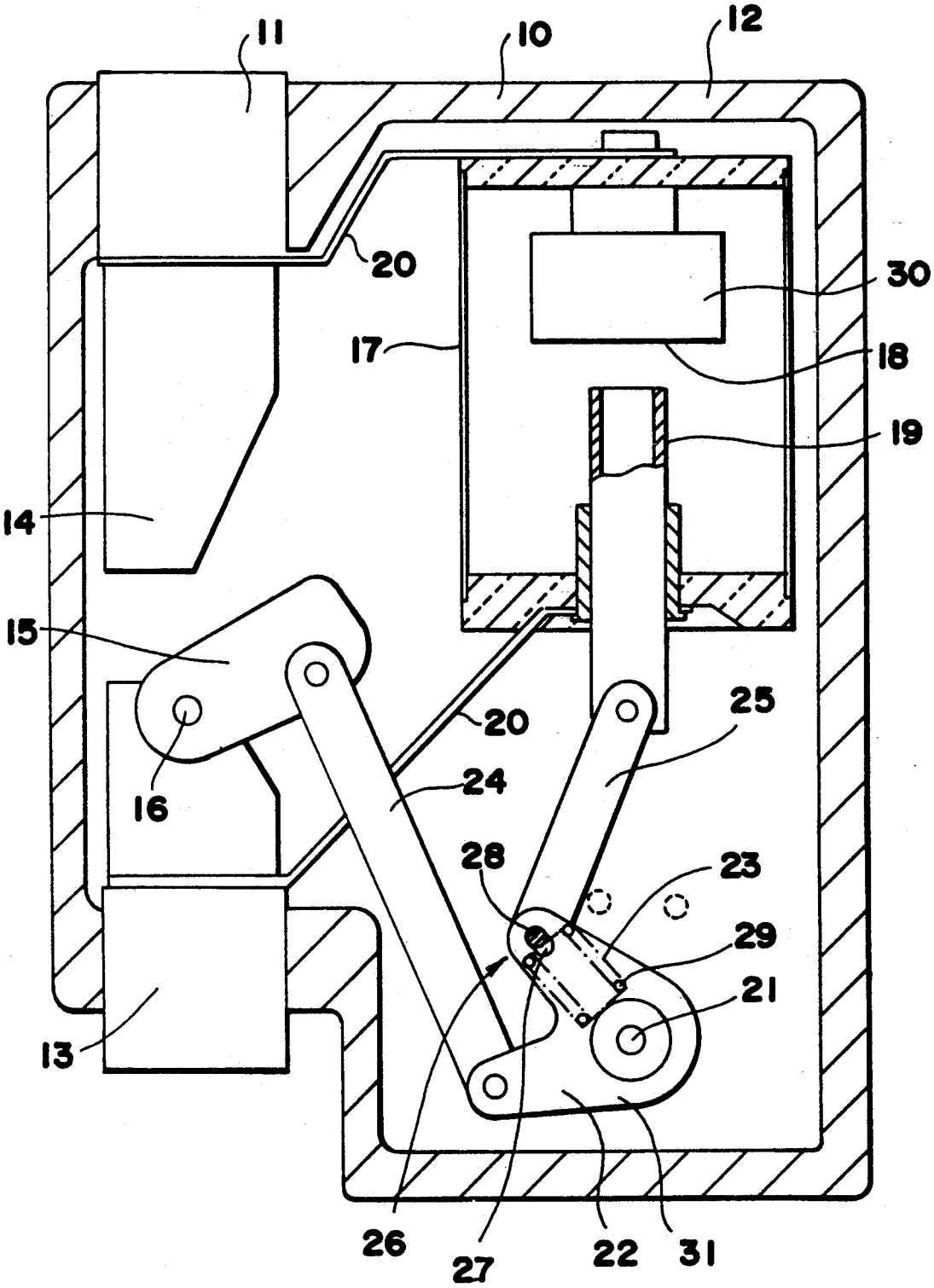
FIG. 1 is a schematic axial section view of a self-extinguishing expansion circuit breaker according to the invention represented in the open position.

In the drawings a medium voltage circuit breaker is housed in a sealed enclosure or casing 10, whose metal or insulating wall 12 can be that of a gas insulation installation or substation or that of a pole-unit or of three pole-units of a circuit breaker. The pole-unit represented in the drawings comprises two bushings 11,13 whose ends internal to the enclosure 10 are arranged respectively as stationary main contact 14 and as support of a movable main contact 1 pivotally mounted on a spindle 16. Inside the enclosure 10 there is located an envelope 17 containing stationary and movable arcing contacts 18 and 19 respectively. The arcing contacts 18,19 are electrically connected by the conductors 20, respectively to the bushings 11 and 13 and in the closed position, the arcing contacts 18,19 shunt the main contacts 14,15. The envelope 17 represented in FIGS. 1 to 3, constitutes an arc chute of an arc extinguishing device by selfextinguishing expansion and/or rotating arc. The envelope 17 communicates with the internal volume of the enclosure 10 via the tubular movable contact 19 and the assembly is filled with sulphur hexafluoride.

A rotating operating shaft 21 passes through the wall 12 and bears at its internal end a crank 31 having arms 22 and 23. First arm 22 is connected to the movable main contact 15 by a rod 25, whereas second arm 23 is connected to the movable arcing contact 19 by a rod 25 comprising a link 26 with dead travel. Link 26 is formed by an elongated aperture 27, arranged in second arm 23 and a crank pin 28 slidingly mounted in the aperture 27 and supported by the rod 25. A compression spring 29 fitted between the second arm 23 and the crank pin 28 biases crank pin 28 towards the bottom of aperture 27 opposite the operating shaft 21. There is associated with the stationary arcing contact 18 a magnetic blowout coil 30 which rotates the arc drawn between the arcing contact 18,19. The compression spring 29 is precompressed at a value corresponding to the electrodynamic repulsion force exerted between the arcing contacts 18,19 in the closed position due to current flow. In the open position represented in FIG. 1, the main contacts 14,15 and arcing contacts 18,19 are separated. Closing of the circuit breaker is achieved by clockwise rotation in the drawings of the crank 31 which causes pivoting of the main contact 15 and sliding of the movable arcing contact 19. The mechanism is arranged to close the arcing contacts 18,19 just before the main contacts 14,15 close and thus prevent sparks or an arc forming on the latter. Closing of the arcing contacts 18,19 takes place at the moment when the crank pin 28 reaches the position 27' just before alignment of second arm 23 and rod 25. In the course of continued rotation of the crank 31, the movable arcing contact 19, in abutment with the stationary arcing contact 18, remains immobile, whereas the crank pin 28 slides in the aperture 27 against the compression spring 29 to reach the opposite end of this aperture 27 when the dead point (alignment of second arm 23 and rod 25) represented in FIG. 2 is passed. In this position, the main contacts 14,15 are already closed, and continued rotation of the crank 31 results on the one hand in complete closing of the main contacts 14,15, and on the other hand in the dead point being passed causing reverse sliding of the crank pin 28 in the aperture 27 followed by downwards sliding of the movable arcing contact 19. In the closed position of the circuit breaker represented in FIG. 3, the arcing contacts 18,19 are separated and all the current flows through the main contacts 14,15. The length of the elongated aperture 27 is just sufficient to close the arcing contacts 18,19, as represented in FIG. 4, just before the main contacts 14,15, and to keep these arcing contacts 18,19, closed, until closing of the main contacts 14,15 is confirmed. In the example represented in the drawings, the arcing contacts 18,19 are slightly reopened in the closed position of the circuit breaker, but such a reopening is not indispensable and it is conceivable to leave the arcing contacts 18,19 in abutment in the closed position of the circuit breaker. The opening operation is brought about by a reverse rotation of the operation shaft 21 which initially results in reclosing of the arcing contacts 18,19 and the dead point alignment of rod 25 and second arm 23 being passed. In this intermediate position represented in FIG. 2, the main contacts 14,15 are still closed, whereas the crank pin 28 has moved to the opposite end of the aperture 27. Continued rotation of the shaft 21 subsequently results in separation of the main contacts 14,15 and after the dead travel constituted by the aperture 27 has been taken up, in opening of the arcing contacts 18,19.

FIG. 4 represents the opening and closing cycles of the main contacts 14,15 and arcing contacts 18,19, which are moreover well-known to those specialized in the art. The main contacts 14,15 open without an arc forming, the current being switched in the branch circuit comprising the arcing contacts 18,19. As soon as the current is switched, the arcing contacts 18,19 are subjected to the electrodynamic repulsion forces which are compensated by the compression spring 29, thereby preventing opening of the arcing contacts 18,19 liable to cause restriking on the main contacts 14,15.

The travel of the crank pin 28 in the elongated aperture 27 is sufficiently small not to notably modify the compression of the precompressed spring 29, and the energy required for this travel is relatively small. Likewise, the energy restored by the spring 29 to the mechanism after the dead point has been passed is also small.

The precompressed spring 29 is only active in the neighborhood of the dead point of second arm 23 and rod 25, and the torque resulting therefrom on the operating shaft 21 is therefore small. It is clear that the link 26 and the precompressed spring 29 can be located at another location, notably at the level of the movable contact 19 or rod 25. The mechanism drives the movable contacts 15,19 simply and to do this it merely has to overcome the friction forces. It can be easily understood that the use of a precompressed spring according to the invention is particularly advantageous for circuit breakers using a breaking device with low operating energy, notably of the auto- expansion or vacuum break type.

Figure 2:
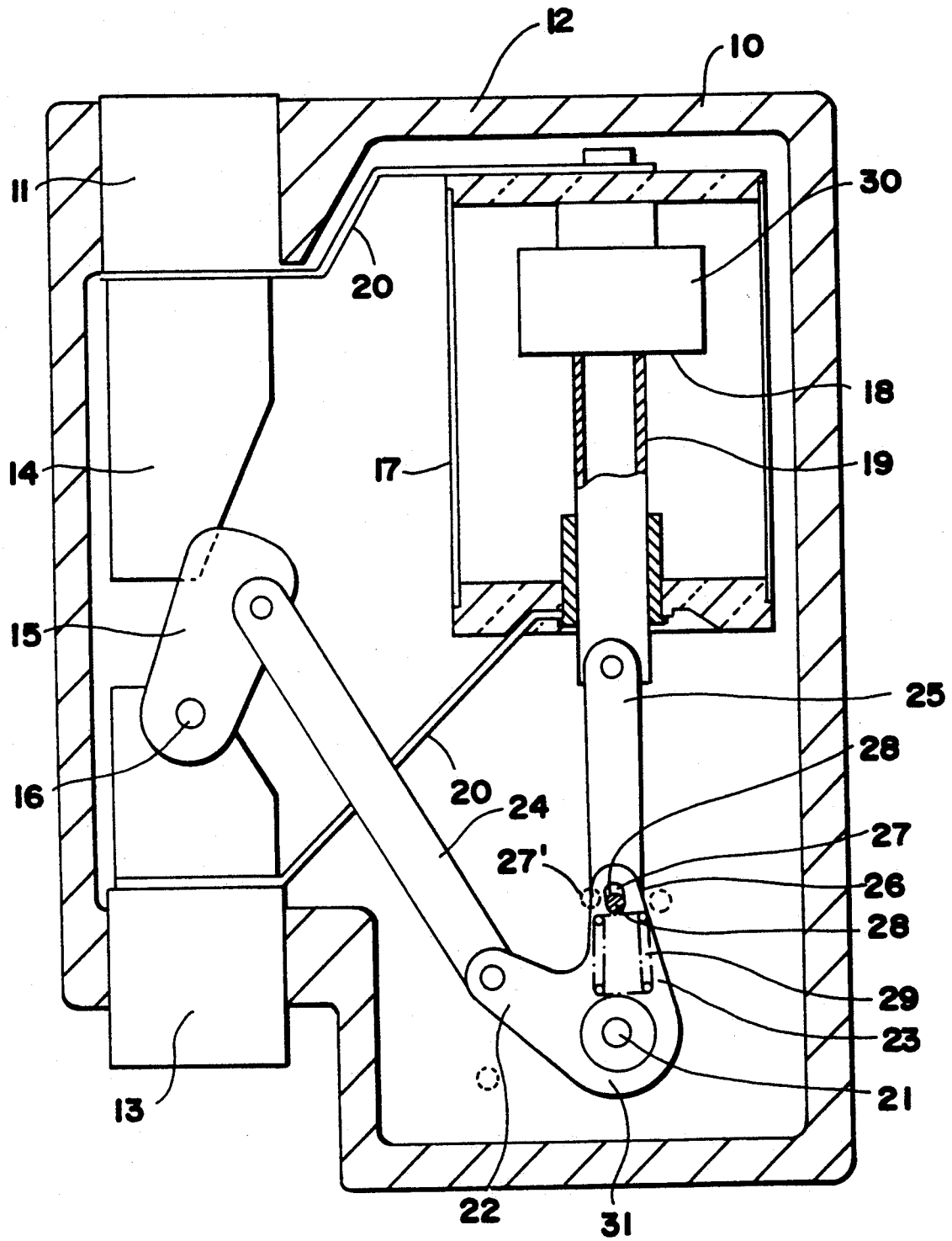
FIGS. 2 and 3 are similar views to that of FIG. 1 showing the circuit breaker respectively in the course of closing and in the closed position.
Figure 3:
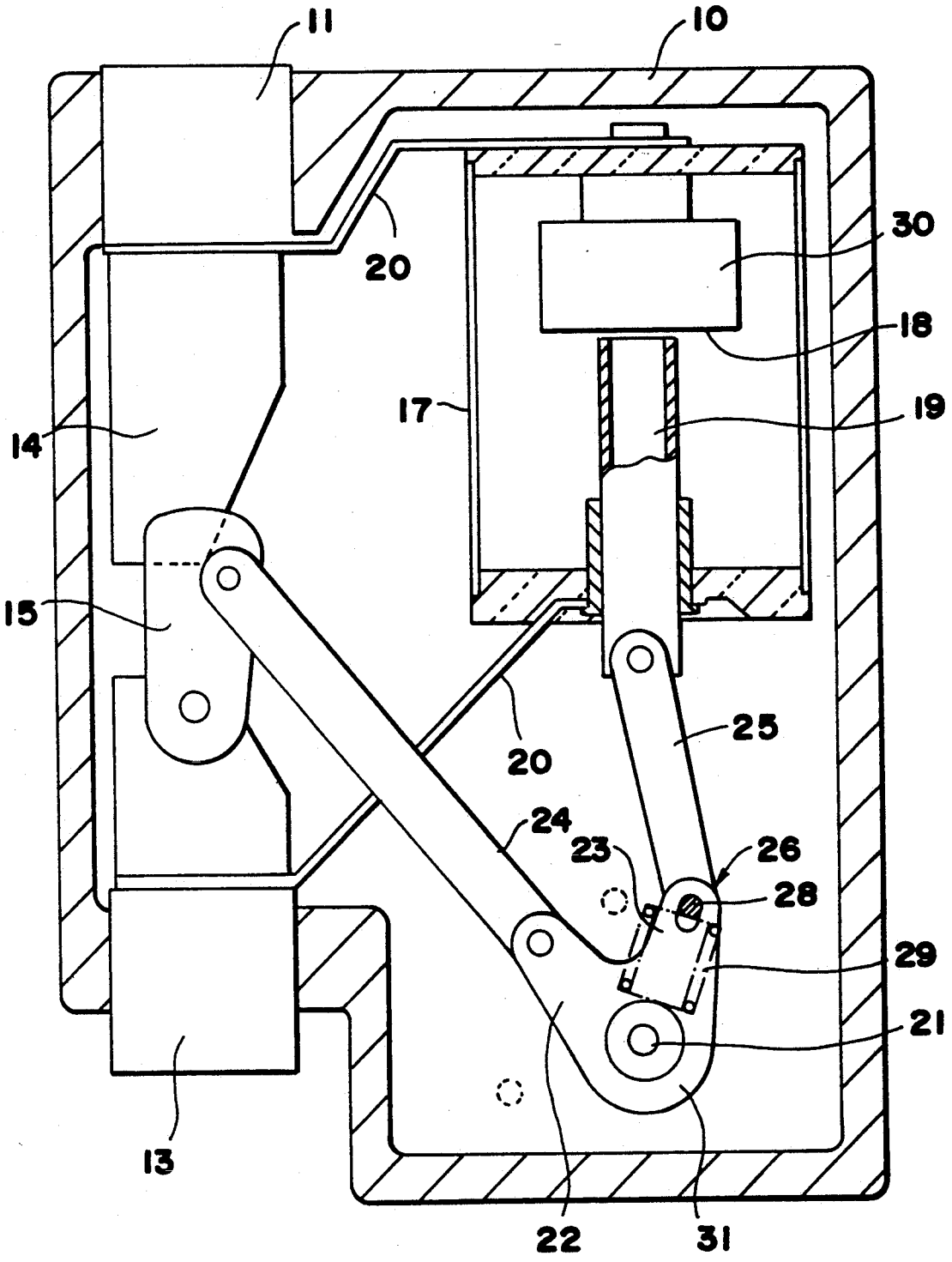
Figure 5:
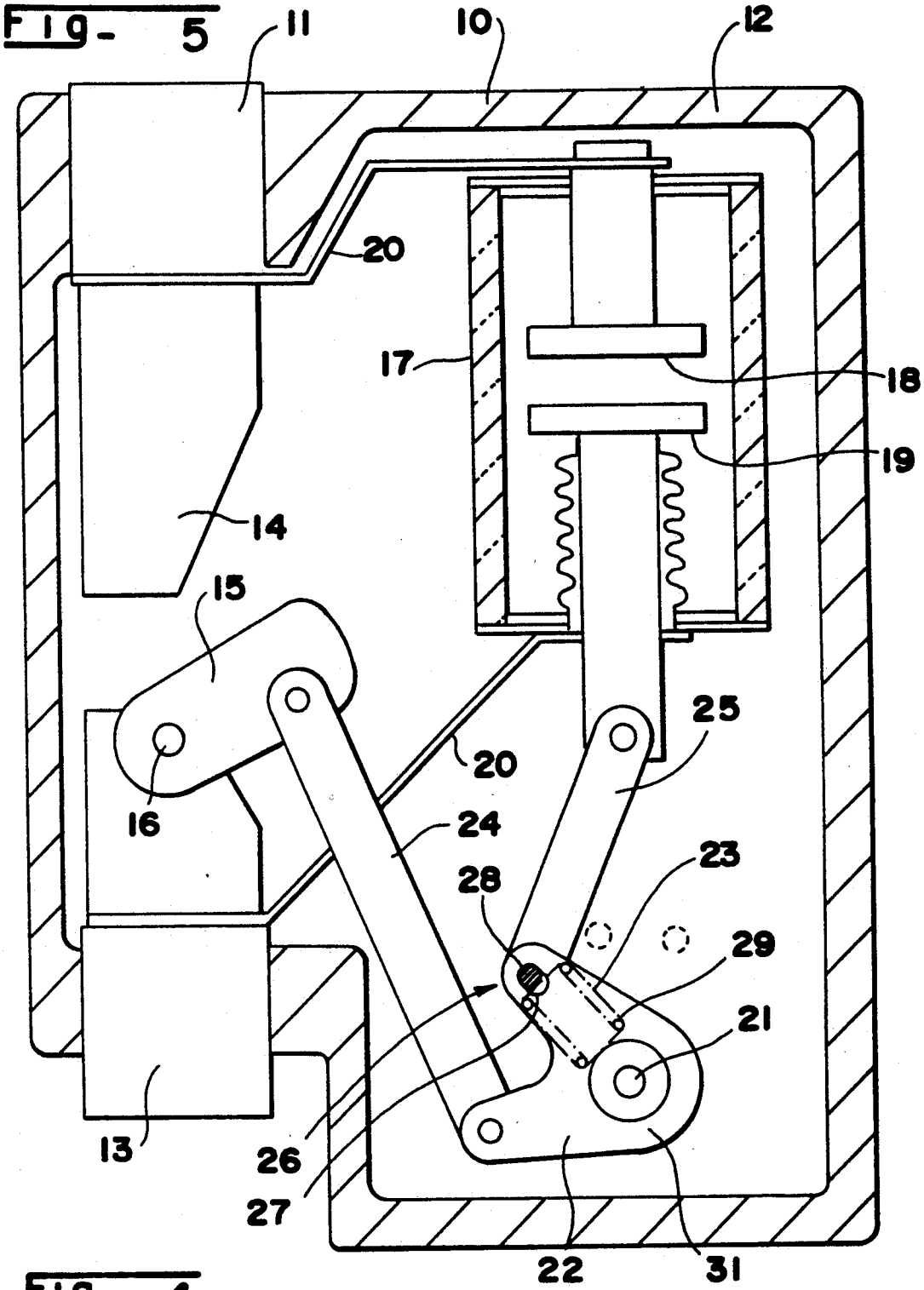
FIG. 5 is a similar view to that of FIG. 1 illustrating a vacuum circuit breaker.
Figure 4:
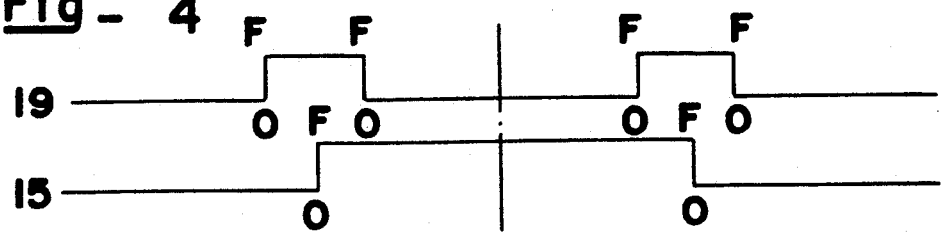
FIG. 4 illustrates the closing and opening cycle of the contacts of the circuit breaker according to FIG. 1.

FIG. 5 illustrates application to a vacuum circuit breaker, the same reference numbers designating similar or identical parts to those in FIGS. 1 and 3. The envelope or cartridge 17 is hermetically sealed in a vacuum, well-known to those specialized in the art, and the other components are identical to those described above.

We claim:

1. A medium voltage circuit breaker, comprising:

first and second arcing contacts, said first arcing contact being longitudinally slidable with respect to the second arcing contact between open and closed positions;

first and second main contacts, said first main contact being movable with respect to the second main contact between open and closed positions;

a sealed enclosure filled with a high dielectric strength gas and housing said first and second arcing and main contacts; and operating means for closing the first and second arcing contacts before the first and second main contacts close and for opening the first and second arcing contacts after the first and second main contacts open, said operating means being mechanically coupled to the first arcing and the first main contacts and comprising a compressible linkage coupled to said first arcing contact, said compressible linkage being compressible a predetermined distance against an urging force provided by a spring as said first and second arcing contacts close, thereby compressing the spring; wherein said operating means is adapted to reduce compression of the spring and reduce a contact force between the first and second arcing contacts after the first and second main contacts have closed.

2. The circuit breaker of claim 1, wherein said compressible linkage comprises a rotatable crank having a first arm extending therefrom, and a first rod having a first end connected to the first arm of said rotatable crank and a second end connected to said first arcing contact.

3. The circuit breaker of claim 2, wherein first arm has an elongated aperture and said first rod has a pin disposed at its first end, said pin being slidable within said aperture to allow compression of said compressible linkage, the spring being positioned to urge the pin toward an end of the aperture to extend the compressible linkage.

4. The circuit breaker of claim 3, wherein the spring is positioned between said pin of the first rod and the first arm of the crank.

5. The circuit breaker of claim 1, further comprising an expansion chamber disposed in said sealed enclosure, said expansion chamber housing said first and second arcing contacts, one of said first and second arcing contacts being tubular to provide gas communication between the enclosure and the expansion chamber.

6. The circuit breaker of claim 5, further comprising a magnetic coil cooperable with the expansion chamber to extinguish an arc generated between the first and second arcing contacts.

7. The circuit breaker of claim 1, further comprising a vacuum cartridge disposed in the enclosure and housing the first and second arcing contacts.

8. The circuit breaker of claim 1, wherein said first main contact is pivotally mounted and connected to a second arm of the rotatable crank by a second rod.

9. The circuit breaker of claim 1, wherein said operating means is adapted to maintain said first arcing contact apart from said second arcing contact after said first and second main contacts are closed.

* * * * *